US010621900B2

(12) United States Patent
Jiang et al.

(10) Patent No.: US 10,621,900 B2
(45) Date of Patent: Apr. 14, 2020

(54) PIXEL ARRAY, DISPLAY PANEL, DISPLAY DEVICE AND DRIVING METHOD

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Luxia Jiang, Beijing (CN); Yuan Wu, Beijing (CN); Fucheng Yang, Beijing (CN); Wenchu Han, Beijing (CN); Jianjun Li, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 39 days.

(21) Appl. No.: 15/777,726

(22) PCT Filed: Sep. 29, 2017

(86) PCT No.: PCT/CN2017/104374

§ 371 (c)(1),
(2) Date: May 21, 2018

(87) PCT Pub. No.: WO2018/077006

PCT Pub. Date: May 3, 2018

(65) Prior Publication Data

US 2018/0336810 A1 Nov. 22, 2018

(30) Foreign Application Priority Data

Oct. 25, 2016 (CN) ..... 2016 1 0961320

(51) Int. Cl.
*G09G 3/3208* (2016.01)
*G09G 3/20* (2006.01)
*G09G 3/36* (2006.01)

(52) U.S. Cl.
CPC ..... *G09G 3/2003* (2013.01); *G09G 3/2092* (2013.01); *G09G 3/3208* (2013.01);
(Continued)

(58) Field of Classification Search
CPC combination set(s) only.
See application file for complete search history.

(56) References Cited

U.S. PATENT DOCUMENTS 6,897,930 B2 5/2005 Nakayoshi et al.
2013/0307868 A1* 11/2013 Jeong ..... G09G 5/02 345/600

(Continued)

FOREIGN PATENT DOCUMENTS

CN 103000092 A 3/2013
CN 103488020 A 1/2014

(Continued)

OTHER PUBLICATIONS

Search Report for Chinese Patent Application No. 201610961320.2 dated Mar. 1, 2017.

(Continued)

*Primary Examiner* — Van N Chow
(74) *Attorney, Agent, or Firm* — Calfee, Halter & Griswold LLP

(57) ABSTRACT

A pixel array, including: a plurality of pixel groups, the pixel group including six sub-pixels arranged in a column direction, wherein a connecting line connecting central points of a first, a third and a fifth sub-pixels is on a first straight line, a connecting line connecting central points of a second, a fourth and a sixth sub-pixels is on a second straight line different from the first straight line, and the first straight line and the second straight line are parallel to the column direction; wherein successive connecting lines connecting central points of the six sub-pixels are in a zigzag form, and a connecting line connecting central points of any two adjacent sub-pixels in the column direction is not perpen- (Continued)

dicular to the first straight line; and wherein in the pixel group, colors of any three adjacent sub-pixels in the column direction are all different.

13 Claims, 6 Drawing Sheets

(52) U.S. Cl.
CPC ... *G09G 3/3607* (2013.01); *G09G 2300/0426* (2013.01); *G09G 2300/0452* (2013.01); *G09G 2300/0465* (2013.01); *G09G 2320/0242* (2013.01)

(56) References Cited

U.S. PATENT DOCUMENTS

2015/0077447 A1 3/2015 Zhang
2015/0355522 A1* 12/2015 Lee ..... G02F 1/167 359/296
2017/0256232 A1 9/2017 Xu et al.
2018/0190733 A1* 7/2018 Hsu ..... G09G 3/3233

FOREIGN PATENT DOCUMENTS

CN 105185248 A 12/2015
CN 105319795 A 2/2016
CN 105957877 A 9/2016
CN 106340251 A 1/2017
CN 206115897 U 4/2017

OTHER PUBLICATIONS

Search Report and Written Opinion for International Application No. PCT/CN2017/104374 dated Jan. 4, 2018.
First Office Action for Chinese Patent Application No. 201610961320.2 dated May 10, 2017.
Second Action for Chinese Patent Application No. 201610961320.2 dated Sep. 1, 2017.
Decision of Rejection for Chinese Patent Application No. 201610961320.2 dated Jan. 11, 2018.

* cited by examiner (PRIOR ART PIXEL ARRAY)

(PRIOR ART PIXEL ARRAY)

PIXEL ARRAY, DISPLAY PANEL, DISPLAY DEVICE AND DRIVING METHOD

RELATED APPLICATION(S)

The present application is the U.S. national phase entry of PCT/CN2017/104374, with an international filing date of Sep. 29, 2017, which claims the priority of the Chinese patent application for utility model No. 201610961320.2 filed on Oct. 25, 2016, an entire disclosure of which is incorporated herein by reference.

TECHNICAL FIELD

The present application relates to the field of display technology, particularly to a pixel array, a display panel, a display device and a driving method.

BACKGROUND

In mobile phone and panel display technology, the active matrix organic light emitting diode (AMOLED) panel has gradually become the mainstream of next generation displays due to its advantages such as autonomous luminescence, bright color, low power consumption, and wide visual angle.

The principle of autonomous luminescence of the AMOLED includes: taking the ITO semiconductor electrode and the metal electrode fabricated on the back plate as the anode and the cathode of the device, and evaporating the organic semiconductor material and the light emitting material onto the substrate. Under the driving of the voltage, electrons and holes are injected into the electron and hole transport layers from the cathode and the anode respectively. The electrons and the holes migrate to the light emitting layer through the electron and hole transport layers respectively, and meet in the light emitting layer, so as to form excitons and excite the light emitting molecules. The latter emits visible light through radiative relaxation.

At present, people have more and more requirements on the resolution and the brightness of the mobile phone or the panel. However, there are still many challenges to produce organic light emitting diode (OLED) display screens with a high quality and a high resolution. For an AMOLED with a high resolution, in a conventional pixel array in a strip arrangement as shown in FIG. 1, the three columns of sub-pixels of red, green, and blue (R, G, B) are arranged repeatedly. When performing display, as shown in FIG. 2, the phenomenon of jagged edge is serious. Moreover, because each column only contains sub-pixels of one color, color mixture may also occur easily.

SUMMARY

Embodiments of the present application provide a pixel array, a display panel, a display device and a driving method, for solving problems such as serious jagged edge and color mixture when performing display in the prior art.

In one aspect, the present application provides a pixel array, comprising: a plurality of pixel groups. The pixel group comprises six sub-pixels arranged in a column direction. A connecting line connecting central points of a first, a third and a fifth sub-pixels is on a first straight line, a connecting line connecting central points of a second, a fourth and a sixth sub-pixels is on a second straight line different from the first straight line, and the first straight line and the second straight line are parallel to the column direction. Successive connecting lines connecting central points of the six sub-pixels are in a zigzag form, and a connecting line connecting central points of any two adjacent sub-pixels in the column direction is not perpendicular to the first straight line. In the pixel group, colors of any three adjacent sub-pixels in the column direction are all different.

In one embodiment, colors of the six sub-pixels in the pixel group are arranged circularly in an order of a first color, a second color and a third color.

In one embodiment, the first color, the second color and the third color are one of red, green and blue respectively.

In one embodiment, in the pixel group, a distance between central points of any two adjacent sub-pixels in the column direction is equal.

In one embodiment, the pixel array comprises a plurality of pixel repeating units arranged in a matrix. Each of the pixel repeating units comprises a first pixel group and a second pixel group arranged in a row direction. An odd sub-pixel in the first pixel group and an even sub-pixel in the second pixel group are located in a same row, and the first pixel group and the second pixel group are staggered by one sub-pixel in the column direction.

In one embodiment, in the pixel repeating unit, a distance between a central point of a first sub-pixel in the first pixel group and a central point of a second sub-pixel in the second pixel group is equal to a distance between central points of any two adjacent sub-pixels in the column direction in the first pixel group.

In one embodiment, in two adjacent columns of pixel repeating units, a distance between any two adjacent pixel groups in the row direction is equal.

In one embodiment, the pixel array further comprises: a white sub-pixel located between any two adjacent columns of pixel repeating units and located between two sub-pixels of an even row, and a white sub-pixel located between two adjacent columns of pixel groups in each column of pixel repeating unit and located between two sub-pixels of an odd row.

In one embodiment, a distance between central points of any two adjacent sub-pixels including the white sub-pixel in a same row is equal.

In one embodiment, a distance between central points of any two adjacent sub-pixels including the white sub-pixel in a same column is equal.

In one embodiment, in the pixel repeating unit, connecting lines connecting central points of a first, a second and a third sub-pixels in at least the first pixel group and a second, a third and a fourth sub-pixels in the second pixel group form a regular hexagon, and connecting lines connecting central points of a third, a fourth and a fifth sub-pixels in the first pixel group and a fourth, a fifth and a sixth sub-pixels in the second pixel group form a regular hexagon. A central point of the white sub-pixel is located at a center of the regular hexagon.

In another aspect, the present application provides a display panel comprising the pixel array as stated above.

In yet another aspect, the present application provides a display device comprising the display panel as stated above.

In still another aspect, the present application provides a driving method of the display panel as stated above. In each column of pixel groups, two adjacent sub-pixels are taken as a pixel unit. The method comprises driving the pixel units to emit light successively, and when driving each of the pixel units to emit light, driving a sub-pixel, having a color different from that of the two sub-pixels in the driven pixel unit, in a next pixel unit in the column direction to emit light.

In one embodiment, the driving method comprises, in each column of pixel groups, driving sub-pixels in at least a second pixel unit to a second-to-last pixel unit to emit light twice.

In one embodiment, the driving method comprises, when a white sub-pixel is arranged in the pixel array, driving the white sub-pixel to emit light only when displaying a gray scale image In the above pixel array, display panel, display device and driving method provided by embodiments of the present application, each pixel group comprises six sub-pixels arranged in the column direction. The connecting line connecting central points of the first, the third and the fifth sub-pixels is on a first straight line. The connecting line connecting central points of the second, the fourth and the sixth sub-pixels is on a second straight line different from the first straight line, wherein the first straight line and the second straight line are parallel to the column direction. The successive connecting lines connecting central points of the six sub-pixels are in a zigzag form, and the connecting line connecting the central points of any two adjacent sub-pixels in the column direction is not perpendicular to the first straight line. I.e., the six sub-pixels are in a dotted and staggered arrangement. Therefore, the phenomenon of jagged edge can be reduced. Moreover, because in the pixel group, the colors of any three adjacent sub-pixels in the column direction are all different, the color mixture phenomenon can be improved compared to the prior art in which one column only contains sub-pixels of one color.

DETAILED DESCRIPTION OF THE EMBODIMENTS

Figure 1:
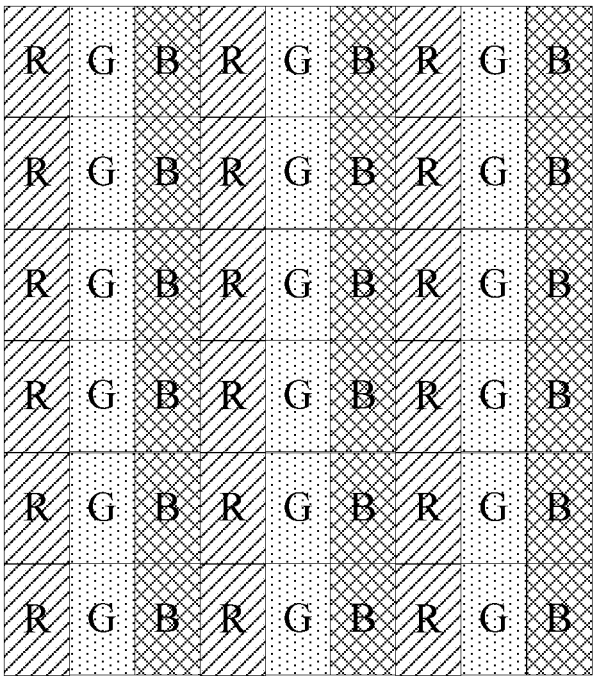
FIG. 1 is a structural schematic view of an existing pixel array.
Figure 2:
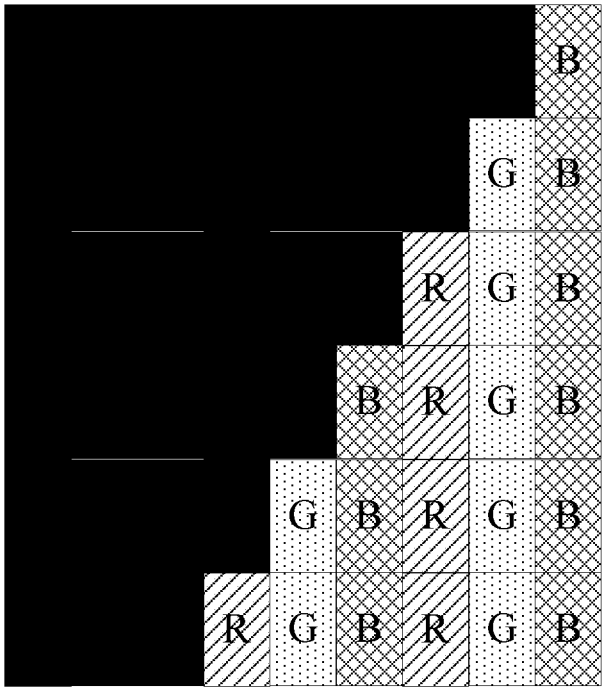
FIG. 2 is a schematic view for a phenomenon of jagged edge in the image when the existing pixel array performs display.

In order to enable the objects, technical solutions and advantages of the present application to be more explicit, in the following, the present application will be further described in detail with reference to the drawings. Apparently, the embodiments described are only a part of rather than all of the embodiments of the present application. Based on these embodiments, all other embodiments, obtained by the ordinary skilled person in the art on the premise of not paying any inventive efforts, belong to the protection scope of the present application.

Shapes and sizes of the components in the drawings do not reflect the real proportion, which only aim to schematically illustrate the present application.

Figure 3:
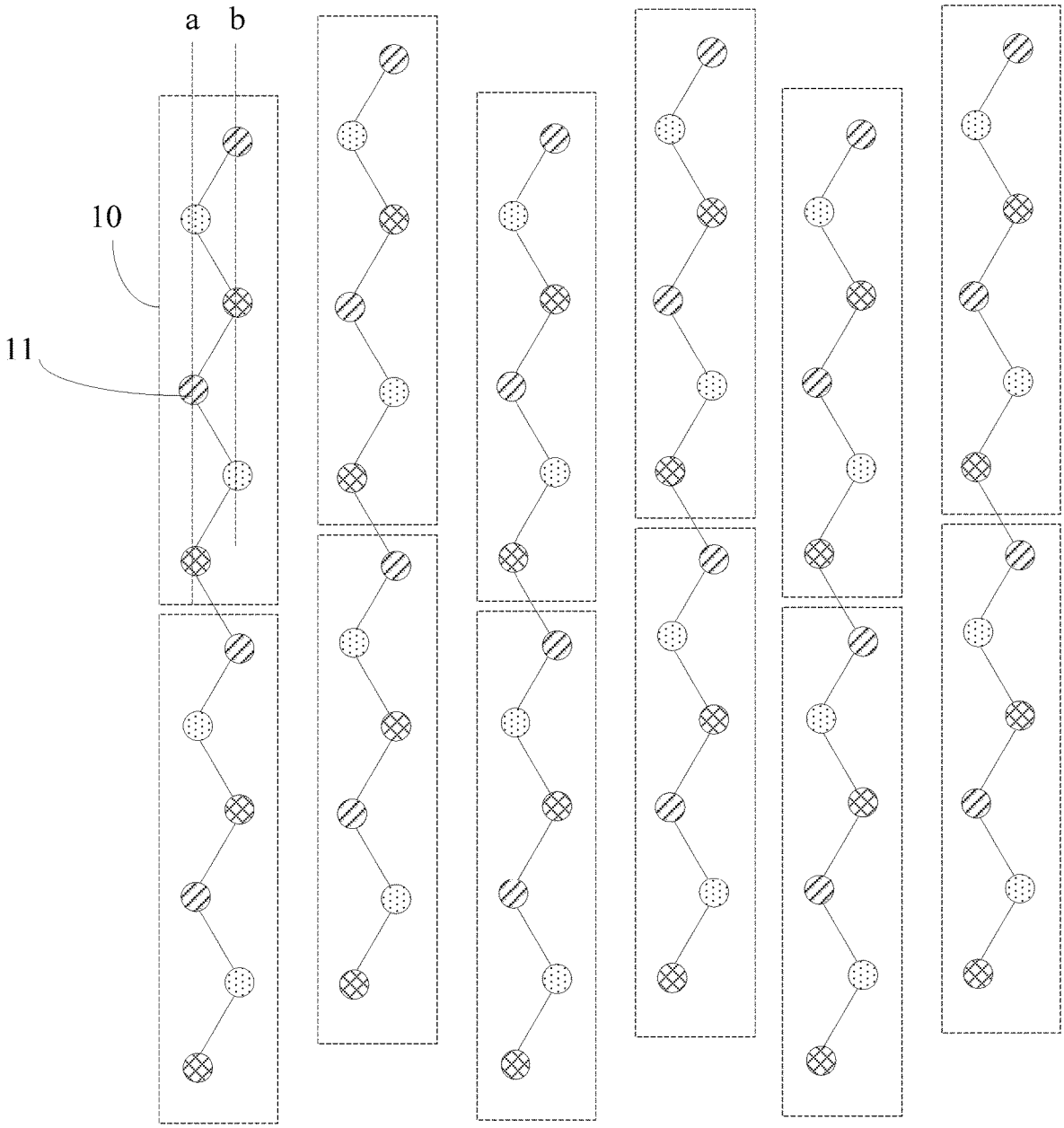
FIG. 3 is a structural schematic view of a pixel array provided by an embodiment of the present application.

An embodiment of the present application provides a pixel array, as shown in FIG. 3, comprising a plurality of pixel groups 10. The pixel group 10 comprises six sub-pixels 11 arranged along a column direction. The connecting line connecting the central points of the first, the third and the fifth sub-pixels 11 is on a first straight line a, the connecting line connecting the central points of the second, the fourth and the sixth sub-pixels 11 is on a second straight line b different from the first straight line a, and the first straight line a and the second straight line b are parallel to the column direction. The successive connecting lines connecting the central points of the six sub-pixels 11 are in a zigzag form, and the connecting line connecting the central points of any two adjacent sub-pixels 11 in the column direction is not perpendicular to the first straight line a. In the pixel group 10, colors of any three adjacent sub-pixels 11 in the column direction are all different.

Figure 4:
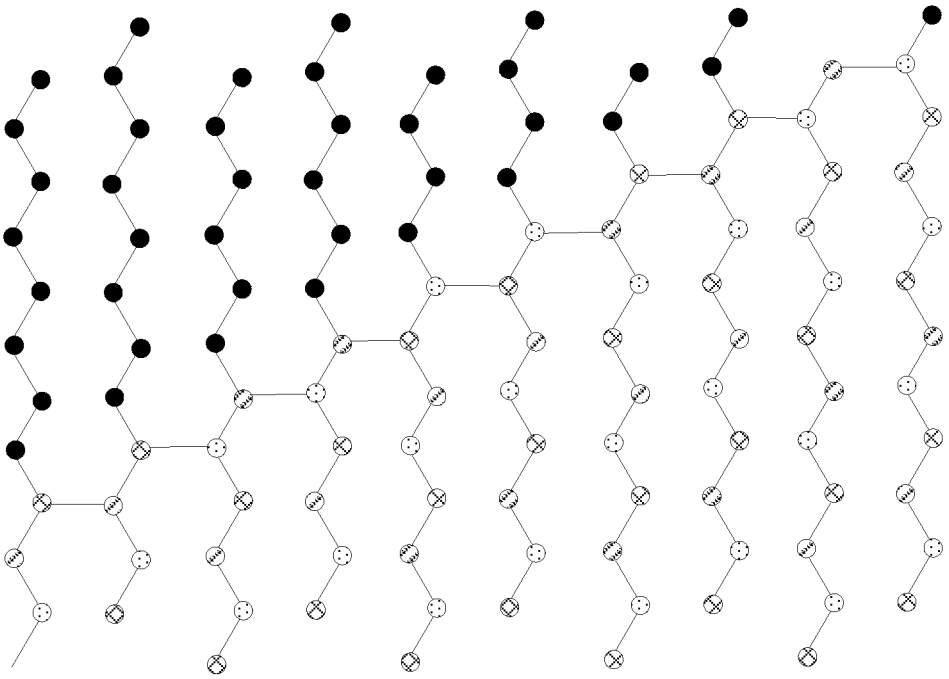
FIG. 4 is a schematic view for a phenomenon of jagged edge in the image when the pixel array provided by an embodiment of the present application performs display.

In each pixel group, the connecting line connecting central points of the first, the third and the fifth sub-pixels is on a first straight line. The connecting line connecting central points of the second, the fourth and the sixth sub-pixels is on a second straight line different from the first straight line, wherein the first straight line and the second straight line are parallel to the column direction. The successive connecting lines connecting central points of the six sub-pixels are in a zigzag form, and the connecting line connecting the central points of any two adjacent sub-pixels in the column direction is not perpendicular to the first straight line. I.e., the six sub-pixels are in a dotted and staggered arrangement. As shown in FIG. 4, the displayed image has a relatively smooth edge. Hence, the phenomenon of jagged edge can be reduced. Moreover, because in the pixel group, the colors of any three adjacent sub-pixels in the column direction are all different, the color mixture phenomenon can be improved compared to the prior art in which one column only contains sub-pixels of one color.

The colors of the six sub-pixels in the pixel group are set circularly in an order of a first color, a second color and a third color. That is, the colors of the sixth sub-pixels are first color, second color, third color, first color, second color and third color successively.

In specific implementation, the first color, the second color and the third color can be one of red, green and blue respectively. That is, a pixel group includes two red sub-pixels, two green sub-pixels and two blue sub-pixels.

In the pixel group, the distance between the central points of any two adjacent sub-pixels in the column direction is equal. For example, the distance between the central point of the first sub-pixel and the central point of the second sub-pixel is equal to the distance between the central point of the second sub-pixel and the central point of the third sub-pixel.

Figure 5:
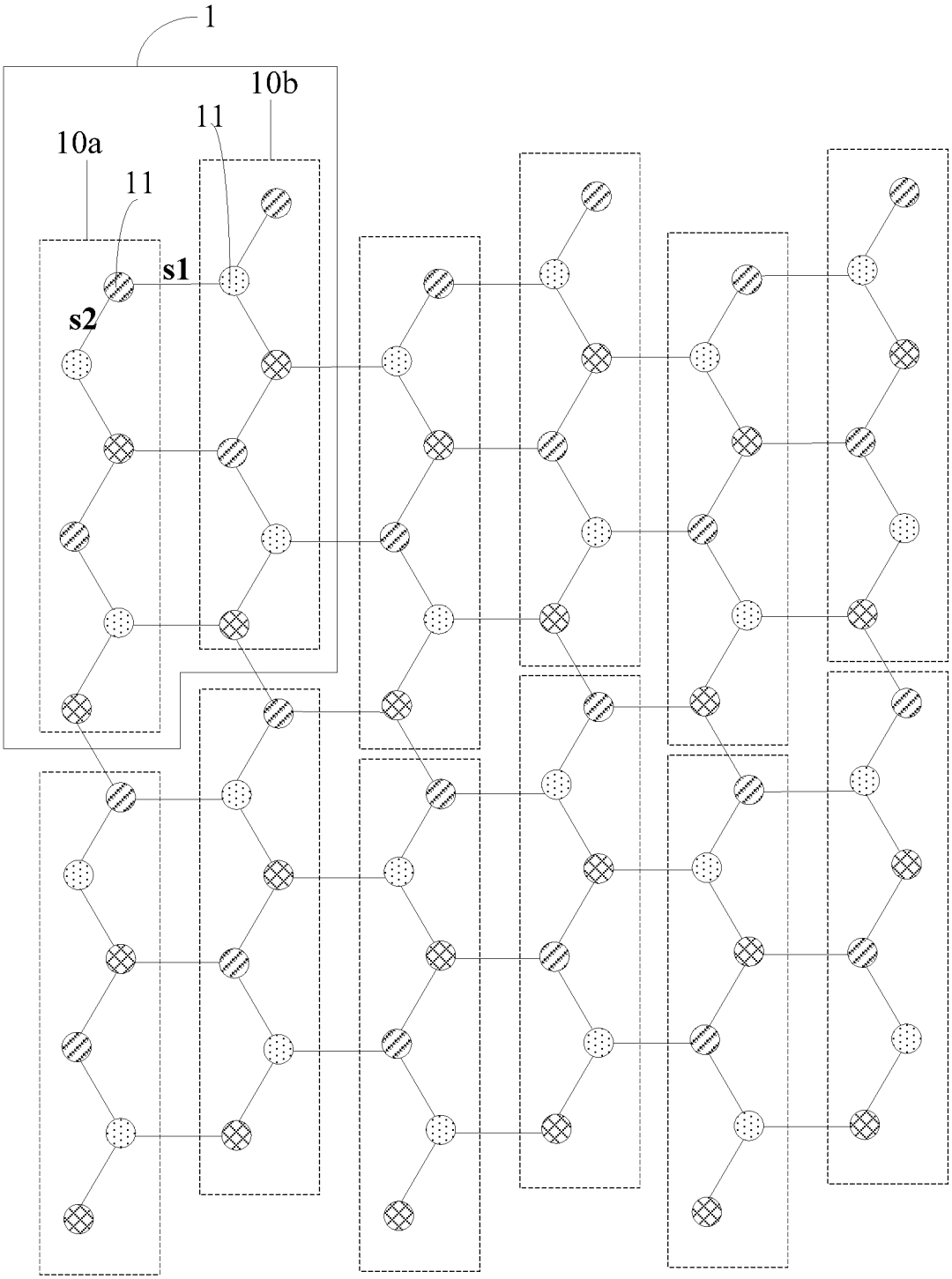
FIG. 5 is a structural schematic view of another pixel array provided by an embodiment of the present application.

As shown in FIG. 5, the pixel array comprises a plurality of pixel repeating units 1 arranged in a matrix. Each pixel repeating unit 1 comprises two pixel groups 10 arranged in the row direction.

An odd sub-pixel 11 in the first pixel group 10*a* and an even sub-pixel 11 in the second pixel group 10*b* are located in the same row, and the first pixel group 10*a* and the second pixel group are staggered by one sub-pixel 11 in the column direction. As shown in FIG. 5, namely, in two columns of pixel groups in each column of pixel repeating unit, the sub-pixels located at the middle are arranged in axial symmetry in position. Because the connecting lines connecting central points of the sub-pixels in each column of pixel group are in a zigzag form, the connecting lines connecting the central points of three adjacent sub-pixels in the first pixel group 10*a* and three adjacent sub-pixels in the second pixel group 10*b* form a hexagon. Further, in the pixel array, each hexagon is arranged close to the peripheral hexagon without blind zone of pixel arrangement, thereby being benefit for increasing the resolution.

As shown in FIG. 5, in the pixel repeating unit 1, a distance s1 between the central point of the first sub-pixel 11 in the first pixel group 10*a* and the central point of the second sub-pixel 11 in the second pixel group 11*b* is equal to a distance s2 between the central points of any two adjacent sub-pixels 11 in the first pixel group 10*a*. That is, the hexagon formed is a regular hexagon, thereby increasing the resolution to the most extent.

In two adjacent columns of pixel repeating units, the distance between any two adjacent pixel groups along the row direction is equal. That is, in any two adjacent columns of pixel groups, the sub-pixels located at the middle are arranged in axial symmetry in position, thereby ensuring a uniform distribution of all the sub-pixels in the pixel array.

Figure 6:
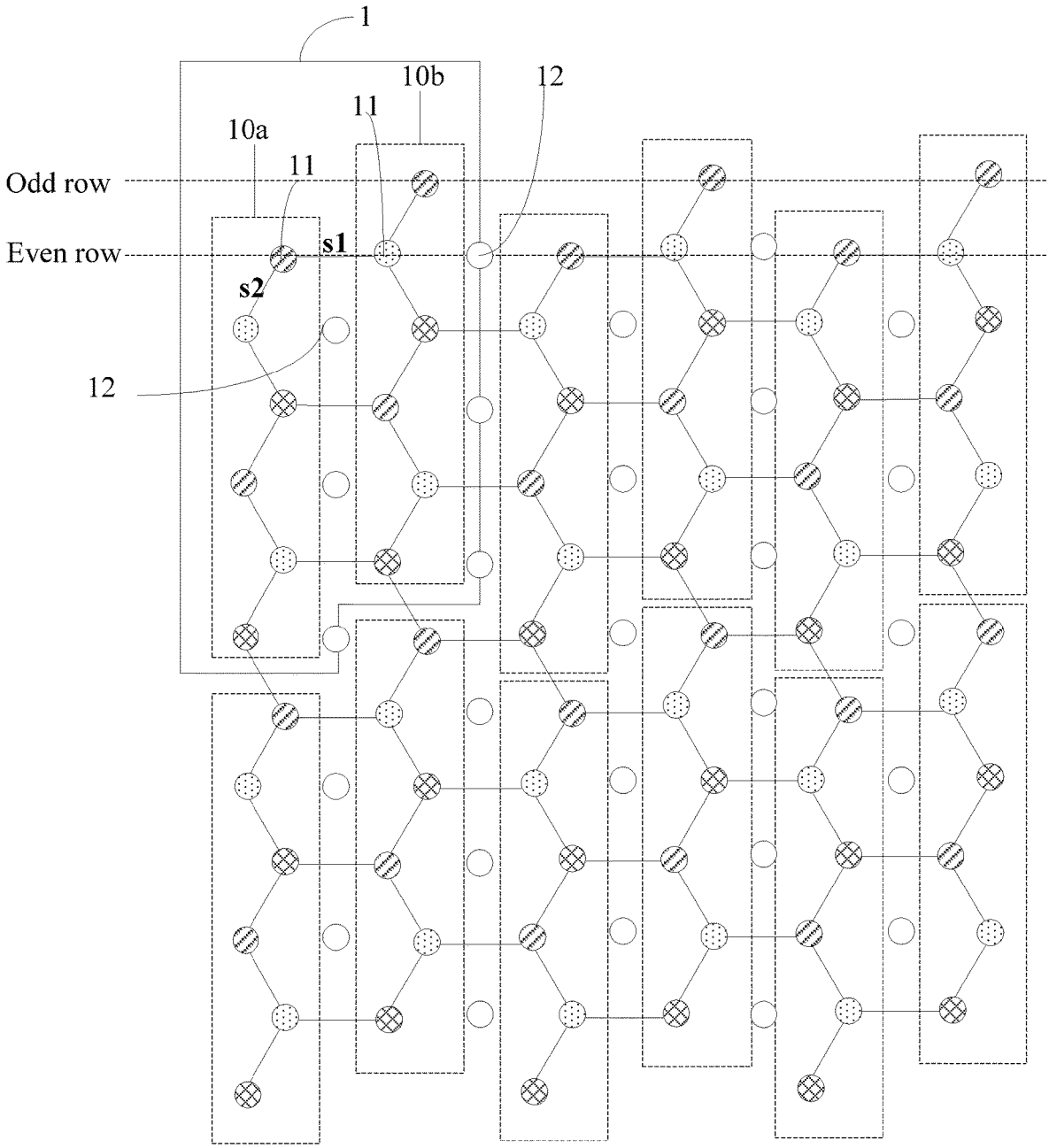
FIG. 6 is a structural schematic view of another pixel array provided by an embodiment of the present application.

As shown in FIG. 6, the pixel array further comprises: a white sub-pixel 12 located between any two adjacent columns of pixel repeating units 1 and located between two sub-pixels 11 of an even row; and a white sub-pixel 12 located between two adjacent columns of pixel groups 10 in each column of pixel repeating unit 1 and located between two sub-pixels 11 of an odd row. Thus, it is equivalent to arranging a white pixel in the hexagon, so that no color edge phenomenon occurs when displaying white texts or figures. The display of a gray scale image can be achieved by only driving the white sub-pixel, thus reducing power consumption.

In a same row, the distance between central points of any two adjacent sub-pixels including the white sub-pixel is equal. That is, in the same row, the distance between two adjacent sub-pixels is equal to the distance between the white sub-pixel and an adjacent sub-pixel.

In a same column, the distance between central points of any two adjacent sub-pixels including the white sub-pixel is equal. Thus, the central point of each white sub-pixel is located at the center of the regular hexagon.

Next, the pixel array provided by an embodiment of the present application will be explained in a specific embodiment.

As shown in FIG. 6, in the pixel repeating unit 1, the connecting lines connecting central points of a first, a second and a third sub-pixels 11 in at least the first pixel group 10*a* and a second, a third and a fourth sub-pixels 11 in the second pixel group 10*b* form a regular hexagon. The connecting lines connecting central points of a third, a fourth and a fifth sub-pixels 11 in the first pixel group 10*a* and a fourth, a fifth and a sixth sub-pixels 11 in the second pixel group 10*b* form a regular hexagon. The central point of the white sub-pixel 12 is located at the center of the regular hexagon.

In this way, the connecting lines connecting the central points of the six sub-pixels in the pixel array form a regular hexagon, where each regular hexagon and its adjacent regular hexagon share two sub-pixels. The white sub-pixel is arranged at the center of the regular hexagon, so as to enable the sub-pixels to be closely arranged without blind zone of pixel arrangement, thereby being benefit for increasing the resolution. The arrangement of the white sub-pixel can not only increase the display effect. Moreover, the display of a gray scale image can be achieved by only driving the white sub-pixel, so as to reduce power consumption.

In specific implementation, the shapes of the sub-pixels can be round or polygonal etc., which will not be defined herein. In order to ensure the aperture ratio, the corresponding sides of adjacent sub-pixels are preferably parallel.

Based on the same inventive concept, an embodiment of the present application further provides a display panel, comprising any of the above pixel array provided by an embodiment of the present application. The presence of all other essential composite parts of the display panel should be understood by the ordinary skilled person in the art, which will not be repeated herein, and should not be taken as limitations to the present application. Because the principle of the display panel for solving the problems is similar to the above pixel array, the implementation of the display panel can make reference to that of the above pixel array, which will not be repeated.

In specific implementation, the above display panel provided by an embodiment of the present application can be either a liquid crystal display panel or an organic light emitting diode display panel, which will not be defined here.

Based on the same inventive concept, an embodiment of the present application further provides a display device, comprising any of the above display panel provided by an embodiment of the present application. The display device can be any product or component with the display function, such as a mobile phone, a panel computer, a television, a display, a laptop, a digital photo frame, a navigator etc. The implementation of the display device can make reference to that of the above display panel, which will not be repeated.

Figure 7:
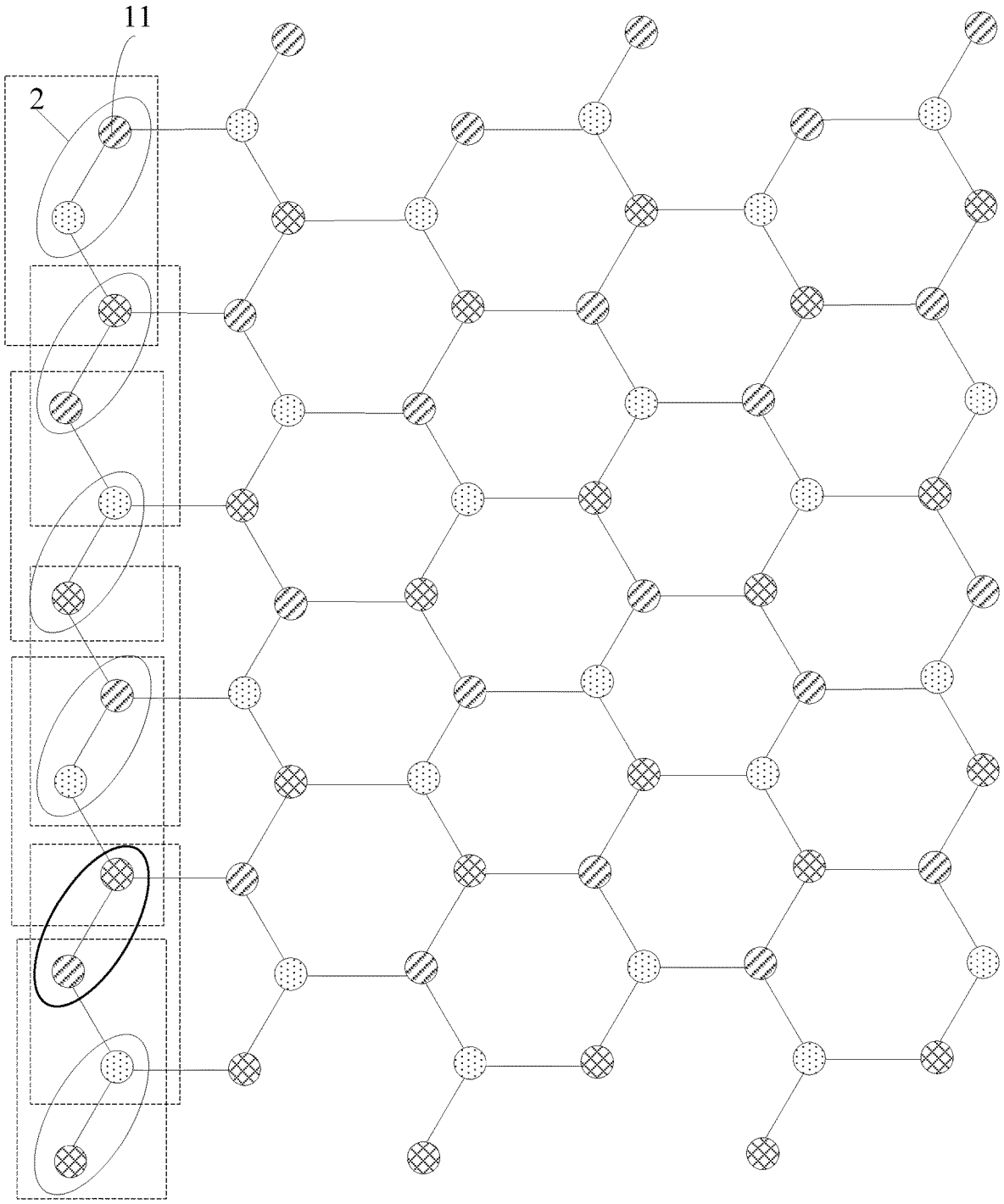
FIG. 7 is a schematic view for sharing sub-pixels when the display panel provided by an embodiment of the present application is driven.

Based on the same inventive concept, an embodiment of the present application further provides a driving method of the above display panel. As shown in FIG. 7, in each column of pixel groups, two adjacent sub-pixels are taken as a pixel unit 2. The method comprises driving each of the pixel units 2 to emit light successively, and also driving a sub-pixel, having a color different from that of the two sub-pixels in the driven pixel unit, in a next pixel unit in the column direction to emit light, while driving each of the pixel units to emit light.

In each column of pixel groups, two adjacent sub-pixels are taken as a pixel unit. The pixel units are driven to emit light successively, and a sub-pixel, having a color different from that of the two sub-pixels in the driven pixel unit, in a next pixel unit in the column direction is driven to emit light, while each pixel unit is driven to emit light. Thus, in display, two pixel units share one sub-pixel, which can increase the virtual display resolution of the screen.

In the above driving method provided by an embodiment of the present application, in each column of pixel groups, sub-pixels in at least a second pixel unit to a second-to-last pixel unit are driven to emit light twice.

In the above driving method provided by an embodiment of the present application, when a white sub-pixel is arranged in the pixel array, only the white sub-pixel is driven to emit light when displaying each frame of a gray scale image. Arranging the white sub-pixel in the pixel structure can improve the display effect when displaying a color image, and reduce power consumption when displaying a gray scale image.

In the above pixel array, display panel, display device and driving method provided by embodiments of the present application, each pixel group comprises six sub-pixels arranged in the column direction. The connecting line connecting central points of the first, the third and the fifth sub-pixels is on a first straight line. The connecting line connecting central points of the second, the fourth and the sixth sub-pixels is on a second straight line different from the first straight line, wherein the first straight line and the second straight line are parallel to the column direction. The successive connecting lines connecting central points of the six sub-pixels are in a zigzag form, and the connecting line connecting the central points of any two adjacent sub-pixels in the column direction is not perpendicular to the first straight line. That is, the six sub-pixels are in a dotted and staggered arrangement. Therefore, the phenomenon of jagged edge can be reduced. Moreover, because in the pixel group, the colors of any three adjacent sub-pixels in the column direction are all different, the color mixture phenomenon can be improved compared to the prior art in which one column only contains sub-pixels of one color.

Apparently, the skilled person in the art can make various amendments and modifications to the present application without departing from the spirit and the scope of the present application. In this way, provided that these amendments and modifications of the present application belong to the scopes of the claims of the present application and equivalent technologies thereof, the present application also intends to encompass these amendments and modifications.

The invention claimed is:

1. A method of driving a display panel, wherein the display panel comprises a pixel array comprising a plurality of pixel groups, each pixel group comprising six sub-pixels arranged in a column direction, wherein a connecting line connecting central points of first, third and fifth sub-pixels is on a first straight line, a connecting line connecting central points of second, fourth and sixth sub-pixels is on a second straight line different from the first straight line, and the first straight line and the second straight line are parallel to the column direction, wherein successive connecting lines connecting central points of the six sub-pixels are in a zigzag form, and a connecting line connecting central points of any two adjacent sub-pixels in the column direction is not perpendicular to the first straight line, and wherein within each pixel group, colors of any three adjacent sub-pixels in the column direction are all different, wherein, in each column of pixel groups, two adjacent sub-pixels are taken as a pixel unit, the method comprising:

driving a plurality of pixel units to emit light successively; and when driving each of the pixel units to emit light, driving a sub-pixel, having a color different from that of the two sub-pixels in the driven pixel unit, in a next pixel unit in the column direction to emit light, wherein, in each column of pixel groups, sub-pixels in at least a second pixel unit to a second-to-last pixel unit are driven to emit light twice.

2. The method as claimed in claim 1, further comprising, when a white sub-pixel is arranged in the pixel array, driving the white sub-pixel to emit light only when displaying a gray scale image.

3. The method as claimed in claim 1, further comprising, when a white sub-pixel is arranged in the pixel array, driving the white sub-pixel to emit light only when displaying a gray scale image.

4. The method as claimed in claim 1, wherein colors of the six sub-pixels in each pixel group are arranged circularly in an order of a first color, a second color and a third color.

5. The method as claimed in claim 4, wherein the first color, the second color and the third color are red, green and blue respectively.

6. The method as claimed in claim 1, wherein within each pixel group, a distance between central points of any two adjacent sub-pixels in the column direction is equal.

7. The method as claimed in claim 6, wherein the pixel array further comprises a plurality of pixel repeating units arranged in a matrix, and each of the pixel repeating units comprises a first pixel group and a second pixel group arranged in a row direction; and wherein an odd sub-pixel in the first pixel group and an even sub-pixel in the second pixel group are located in a same row, and the first pixel group and the second pixel group are staggered by one sub-pixel in the column direction.

8. The method as claimed in claim 7, wherein, in the pixel repeating unit, a distance between a central point of a first sub-pixel in the first pixel group and a central point of a second sub-pixel in the second pixel group is equal to a distance between central points of any two adjacent sub-pixels in the column direction in the first pixel group.

9. The method as claimed in claim 7, wherein, in two adjacent columns of pixel repeating units, a distance between any two adjacent pixel groups in the row direction is equal.

10. The method as claimed in claim 7, further comprising:

a white sub-pixel located between any two adjacent columns of pixel repeating units and located between two sub-pixels of an even row;

a white sub-pixel located between two adjacent columns of pixel groups in each column of a pixel repeating unit and located between two sub-pixels of an odd row.

11. The method as claimed in claim 10, wherein a distance between central points of any two adjacent sub-pixels including the white sub-pixel in a same row is equal.

12. The method as claimed in claim 10, wherein a distance between central points of any two adjacent sub-pixels including the white sub-pixel in a same column is equal.

13. The method as claimed in claim 10, wherein in the pixel repeating unit, connecting lines connecting central points of first, second and third sub-pixels in at least the first pixel group and second, third and fourth sub-pixels in the second pixel group form a regular hexagon, connecting lines connecting central points of the third, fourth and fifth sub-pixels in the first pixel group and the fourth, fifth and sixth sub-pixels in the second pixel group form a regular hexagon; and a central point of the white sub-pixel is located at a center of the regular hexagon.

* * * * *